US012129675B1

(12) United States Patent
Rios et al.

(10) Patent No.: US 12,129,675 B1
(45) Date of Patent: Oct. 29, 2024

(54) UMBRELLA ANCHORING, STABILIZING, AND ACCESSORY HOLDING ASSEMBLY

(71) Applicants: Charles V. Rios, Milton, FL (US); Paul O. Melder, Jr., Pace, FL (US); Raymond Josef Anderson, Milton, FL (US)

(72) Inventors: Charles V. Rios, Milton, FL (US); Paul O. Melder, Jr., Pace, FL (US); Raymond Josef Anderson, Milton, FL (US)

( * ) Notice: Subject to any disclaimer, the term of this patent is extended or adjusted under 35 U.S.C. 154(b) by 262 days.

(21) Appl. No.: 17/745,108

(22) Filed: May 16, 2022

(51) Int. Cl.

| | |
|---|---|
| ***A45B 23/00*** | (2006.01) |
| ***A47B 13/00*** | (2006.01) |
| ***A47B 13/02*** | (2006.01) |
| ***A47B 13/08*** | (2006.01) |
| ***A47B 37/00*** | (2006.01) |
| ***E04H 12/22*** | (2006.01) |

(52) U.S. Cl.
CPC ..... *E04H 12/2215* (2013.01); *A45B 23/00* (2013.01); *A47B 13/003* (2013.01); *A47B 13/023* (2013.01); *A47B 13/08* (2013.01); *A47B 37/00* (2013.01); *E04H 12/2269* (2013.01); *A45B 2023/0012* (2013.01); *A45B 2200/1063* (2013.01); *A47B 2013/006* (2013.01)

(58) Field of Classification Search
CPC ..... A45B 2200/1063
See application file for complete search history.

(56) References Cited

U.S. PATENT DOCUMENTS

| | | | | |
|---|---|---|---|---|
| 2,597,157 | A * | 5/1952 | Martino | A47G 25/08 126/30 |
| 2,643,843 | A * | 6/1953 | Brown | E04H 12/2223 52/165 |
| 3,823,785 | A | 7/1974 | Toliver | |
| 4,753,411 | A * | 6/1988 | Lechner | E04H 12/2215 52/165 |
| 5,505,645 | A | 4/1996 | Engler, Jr. | |
| 5,692,720 | A | 12/1997 | Griggs | |
| 5,823,496 | A | 10/1998 | Foley et al. | |
| 6,267,127 | B1 | 7/2001 | Doreste | |
| 6,374,839 | B2 * | 4/2002 | Patarra | A45C 11/20 135/16 |

(Continued)

*Primary Examiner* — Noah Chandler Hawk
(74) *Attorney, Agent, or Firm* — Glenn E. Gold, P.A.; Glenn E. Gold

(57) ABSTRACT

A combination umbrella anchoring, stabilizing, and accessory holding assembly facilitates anchoring of an umbrella in shallow water along a shoreline. A tubular, main support rod has a tapered, open-ended, insertion end to facilitate insertion into a seabed while encouraging entry of seabed material therein for stability, and an opposite distal attachment end configured as an umbrella holder. A multi-armed support structure releasably attachable to the attachment end of the main support rod is adapted to securely hold beverage containers, and functions to support a planar tabletop thereon. Accessory supporting components depend downwardly from a lower surface of the tabletop to support hanging accessories. A stabilizing plate mounted about, and releasably secured to, the main support rod functions to stabilize the assembly in a generally upright orientation, while acting against any undesirable upward force, e.g., caused by wind acting against an umbrella canopy.

15 Claims, 7 Drawing Sheets

(56) References Cited

U.S. PATENT DOCUMENTS

| | | | | |
|---|---|---|---|---|
| 6,953,180 | B1 | 10/2005 | Ruvalcaba et al. | |
| 7,475,859 | B2 | 1/2009 | Selders | |
| 7,520,485 | B1 | 4/2009 | Giannetto | |
| 9,028,288 | B2 * | 5/2015 | Lovett | B63B 22/24 441/32 |
| 9,554,630 | B1 * | 1/2017 | Patel | A45B 25/18 |
| 9,706,834 | B1 * | 7/2017 | Taylor | A45F 3/44 |
| 10,602,817 | B2 * | 3/2020 | Price | A45B 25/00 |
| 11,559,135 | B1 * | 1/2023 | Taylor | A45B 23/00 |
| 2001/0054433 | A1 * | 12/2001 | Patarra | A45C 11/20 62/331 |
| 2003/0079766 | A1 | 5/2003 | Arrowood et al. | |
| 2007/0246091 | A1 * | 10/2007 | Becker | A45B 3/00 135/16 |
| 2009/0189035 | A1 * | 7/2009 | Gambill | A45B 23/00 248/218.4 |
| 2015/0013734 | A1 | 1/2015 | Krystopher et al. | |
| 2018/0128004 | A1 | 5/2018 | Washko | |
| 2019/0335893 | A1 * | 11/2019 | Erickson | A47B 37/04 |
| 2021/0145169 | A1 * | 5/2021 | Schwiebert | A45B 23/00 |

* cited by examiner

UMBRELLA ANCHORING, STABILIZING, AND ACCESSORY HOLDING ASSEMBLY

FIELD OF THE INVENTION

The present invention relates generally to anchorable umbrellas. More particularly, the invention pertains to a combination umbrella anchoring and accessory supporting assembly designed for use in bodies of shallow water (e.g., along a beach, lake, bay or other shoreline).

BACKGROUND OF THE INVENTION

Individuals enjoying leisure time at shoreline areas, such as beaches, lakes and the like, engage in activities that require various items and accessories to make the experience safe, healthy, relaxing, and enjoyable. A typical travel kit to the ocean shore or lakeside may include a beach umbrella, food and beverage items, UV protection (e.g., sunglasses, sunscreen lotion, hat), and perhaps some type of self-guided flotation device to maneuver about in the water. The food and beverage items are typically maintained in a portable cooler to prevent spoiling, while any of a variety of tote bags are conventionally used to carry non-food items and accessories. Visitors to the beach and other shoreline leisure areas commonly carry portable umbrellas (e.g., beach umbrellas) for protection while sunbathing on land adjacent to the water. Conventional beach umbrellas typically include a deployable canopy mounted to the upper end of an umbrella shaft or pole. The lower end of the umbrella shaft may be adapted to include a ground-penetrating tool, such as an auger tip, to facilitate penetration of the umbrella shaft into beach sand via a screw-type driving action of the auger end.

While enjoying leisure time along a shoreline area, individuals generally engage in two different and mutually exclusive experiences; one while in the water, and one while on land. While on land, individuals can experience shaded sunbathing beneath an umbrella while still having access to food, beverages, and various accessories. However, while in the water, individuals no longer have access to a beach umbrella for protection against the sun. Furthermore, access to food, beverages, sunscreen and other miscellaneous accessory items, is greatly restricted.

Modified umbrellas that incorporate some type of support/storage for enabling a user to carry, and easily locate, various items, including clothing and a beverage container, are known. The modified umbrella enhances the range of functionality of the umbrella beyond merely offering sun protection. However, users must remain on land in order to experience full sun protection from the umbrella, and to maintain access to other essential items such as food, beverages, sunscreen, etc. When, for example, a beachgoer decides to enter the water, especially for an extended period, she will typically have to undertake various preliminary tasks (e.g., applying sunscreen, hydrating, consume nourishment, etc.), since access to these items, while in the water, is restricted.

Furthermore, various umbrella mounting devices are known, which incorporate structure for hanging clothing and towels, for holding a beverage container, etc. However, such known umbrella mounting devices are specifically designed to be inserted into dry land, and generally lack the stability to be used within a body of water.

Accordingly, there remains a well-recognized, as of yet unmet, need in the art for an innovation that will overcome the aforementioned deficiencies and limitations of known devices, products and methods, particularly in relation to the development of an all-in-one, integrated, multi-functional umbrella anchoring and accessory holding device having adequate stability to be deployed in shallow bodies of water to provide sunlight protection, to carry items a user may need while in the water for an extended period of time, and to provide a support surface upon which users may place food items, portable accessories, and the like.

SUMMARY OF THE INVENTION

The present invention is generally directed to an umbrella support assembly for supporting an umbrella, such as a conventional beach umbrella (i.e., having a deployable canopy at an upper end of a support pole), within a shallow body of water overlying a seabed or other underwater ground surface, wherein the assembly further incorporates accessory supporting/holding structure integrated therewith. The assembly is designed to facilitate anchoring of an umbrella in shallow water along a shoreline, such as a beach or a lakefront.

The anchoring mechanism incorporates a main central support rod (alternatively referred to herein as a "central support rod." a "main central support pole," or a "central support pole") having a tapered, open-ended, insertion end designed to facilitate insertion of a lower length of the central support rod into the ground, or underlying bed, while encouraging entry of ground material (e.g., sand, mud, etc.) into the insertion end of the central support rod to impart ballast-like stability thereto, and an opposite attachment end for selectively coupling a multi-armed support structure to an upper length of the central support rod via a lower central hub.

A stabilizing plate, alternatively referred to as a "flounder, " may be mounted about and secured to the central pole proximate to its lower insertion end, for imparting added stability against the lateral force of moving water (e.g., waves), the upward/pulling force from wind against the umbrella canopy, etc. The stabilizing plate is slidably adjustable along the central support rod and may be positionally fixed thereto via a central support rod engagement component such as a male threaded stud clamping knob. When the assembly is properly installed and ready for use, the stabilizing plate engages the ground surface beneath the water (e.g., a seabed, securing the central support rod in an upright, or vertical, orientation. The height of the beach umbrella support assembly above the water surface—and, therefore, the corresponding respective heights of the umbrella canopy, the tabletop, and related components—can be easily adjusted by altering the relative position of the stabilizing plate along the central support rod (i.e., by adjusting the embedded length of the central support rod.

The multi-armed support structure coupled to the upper length of the central support rod includes a plurality of horizontally oriented and circumferentially spaced conduit arms extending radially outward from a common central portion where proximal, or interior, ends of the individual conduit arms meet. Each of the conduit arms may be structured, at a distal end, as a beverage container holder. Furthermore, the individual conduit arms may incorporate an interior foam-filled flotation chamber to impart buoyancy, for example, in the event the embedded length of the central support rod becomes inadvertently dislodged from the seabed during use. In at least one optional implementation of the invention, a distal length of each of the conduit arms may incorporate a curvature providing a transition between the horizontally oriented conduit arms and a vertically oriented beverage container holder. For example, the conduit arms may comprise J-shaped conduit arms.

A tabletop is provided mounted upon distal end portions of the individual conduit arms of the multi-armed support structure. Article hanging support components provided depending downwardly from the tabletop may be incorporated to hold, or hang, items for easy access by the user (e.g., a bag containing sunscreen and sunglasses). For example, the article hanging support components may take the form of hanging loops, loop fasteners, ring hook loops, spring snaps, snap hooks, swivel snap hooks, or any other component form from which user articles and/or accessories may be temporarily supported.

In accordance with a first general implementation, the umbrella support assembly may include:

an elongated, tubular main support rod having an open-ended tapered insertion end and an opposite open-ended attachment end, wherein the tubular main support rod is oriented along a beach umbrella support assembly central axis;

a multi-armed support structure releasably attachable to the attachment end of the main support rod, including a plurality of horizontally-oriented tubular arms extending radially outward from a central portion where proximal ends of the plurality of tubular arms meet, and a tubular central hub depending downwardly from the central portion, an upper side of the central portion defining a central upper opening sized and shaped for accommodating an umbrella pole-mounting clamp therein, the central upper opening concentric with the umbrella support assembly central axis; and a tabletop supported upon the multi-armed support structure.

In accordance with an aspect of the invention, as the open, tapered insertion end of the main central support rod penetrates the bed underlying the shallow body water, the bed composition (e.g., sand, mud, etc.) fills the interior of the embedded length of the tapered insertion end to impart ballast-like stability thereto.

In accordance with another aspect, the umbrella support assembly may include a stabilization plate subassembly oriented along the umbrella support assembly central axis, and selectively mountable about a lower end of the main support rod, a distance above the tapered insertion end, to releasably secure the main support rod as the main support rod adopts, during use, a generally vertical orientation with an embedded length of the main support rod lower end, between the stabilization plate subassembly and the tapered insertion end of the main support rod, penetrating the bed underlying the shallow body of water such that the bed material fills the embedded length of the main support rod lower end to provide ballast-like stability.

In accordance with another aspect, the stabilization plate functions to aid in maintaining the main support rod in a generally vertical orientation once a length of the main support rod between the tapered insertion end and the stabilization plate (i.e., the embedded length) has completely penetrated the bed, or ground, underlying the shallow body of water. That is, the stabilization plate engages the ground to counteract lateral forces on the main support rod due, for example, to the lateral force of flowing water against central support rod, the lateral force of wind against the umbrella canopy, etc.

In at least some implementations, the stabilization plate may be defined by a planar annular base portion having upper and lower surfaces, the planar annular base portion transitioning interiorly into an upwardly extending cylindrical wall portion defining a central passageway concentric with the umbrella support assembly central axis. The central passageway may be sized and shaped to accommodate the tapered insertion end of the main support rod therethrough.

In at least some implementations, one or more central support rod engagement components may be integrated with the stabilization plate to enable the releasable attachment of the stabilization plate to the lower end of the central support rod at a desired position therealong. For example, the central support rod engagement component(s) may be a male threaded stud clamping knob, wherein the male threaded stud extends through the cylindrical wall portion of the stabilization plate. The male threaded stud may have a swivel thrust pad on a distal end extending into the central passageway of the cylindrical wall portion of the stabilization plate, and a gripping knob at an opposite, proximal end protruding exteriorly of the cylindrical wall portion.

In accordance with another aspect, the downward force of the shallow body of water imparts a downward force against the upper surface of the annular base portion of the stabilization plate to further secure the position and vertical orientation of the umbrella support assembly. That is, the downward force of the water against the stabilization plate functions to counteract undesirable upward forces that may be caused, for example, by wind blowing against the underside of the umbrella canopy.

In accordance with some implementations, each of the plurality of tubular arms of the multi-armed support structure may include:

a linear inner tubular length having a first interior volume;

an open-ended linear outer tubular length having a second interior volume; and an arcuate intermediate tubular length having a third interior volume, wherein the arcuate intermediate tubular length interconnects the linear inner tubular length and the linear outer tubular length. Furthermore, the open-ended linear outer tubular length may be bounded at a lower end by an interior stop feature protruding interiorly from an interior surface of the outer tube length, and the open-ended linear outer tubular length may have a size and shape that securely accommodates a beverage container therein.

In accordance with some implementations, the tabletop may include:

a central opening extending completely therethrough and concentric with the beach umbrella support assembly central axis; and a plurality of radially-spaced peripheral openings extending completely therethrough, wherein, the plurality of radially-spaced peripheral openings align with open ends of the open-ended linear outer tubular lengths of the plurality of tubular arms of the multi-armed support structure, such that, during assembly of the tabletop to the multi-armed support subassembly, the open-ended linear outer tubular lengths extend completely through the corresponding radially-spaced peripheral openings, and the table is entirely supported upon the arcuate intermediate tubular lengths of the corresponding plurality of tubular arms of the multi-armed support structure. The radially spaced peripheral tabletop openings may be elliptically shaped to accommodate the partial passage of the arcuate intermediate tube lengths therethrough such that the tabletop is supported upon the arcuate intermediate tube lengths.

In accordance with some implementations, article hanging support components (e.g., hooks, loops, spring snaps, etc.) may be provided depending downwardly from the tabletop, for example, to enable bags filled with accessories to be hung therefrom. In this manner, the umbrella support assembly enables user access to items (e.g., sunscreen, sunglasses, towels, etc.) not typically accessible to individuals while they are in the water.

In accordance with some implementations, a volume of buoyant flotation material may fill the tubular arms of the multi-armed support structure, to aid with flotation of the umbrella support assembly if the insertion end of the main central support rod is inadvertently dislodged from the seabed.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
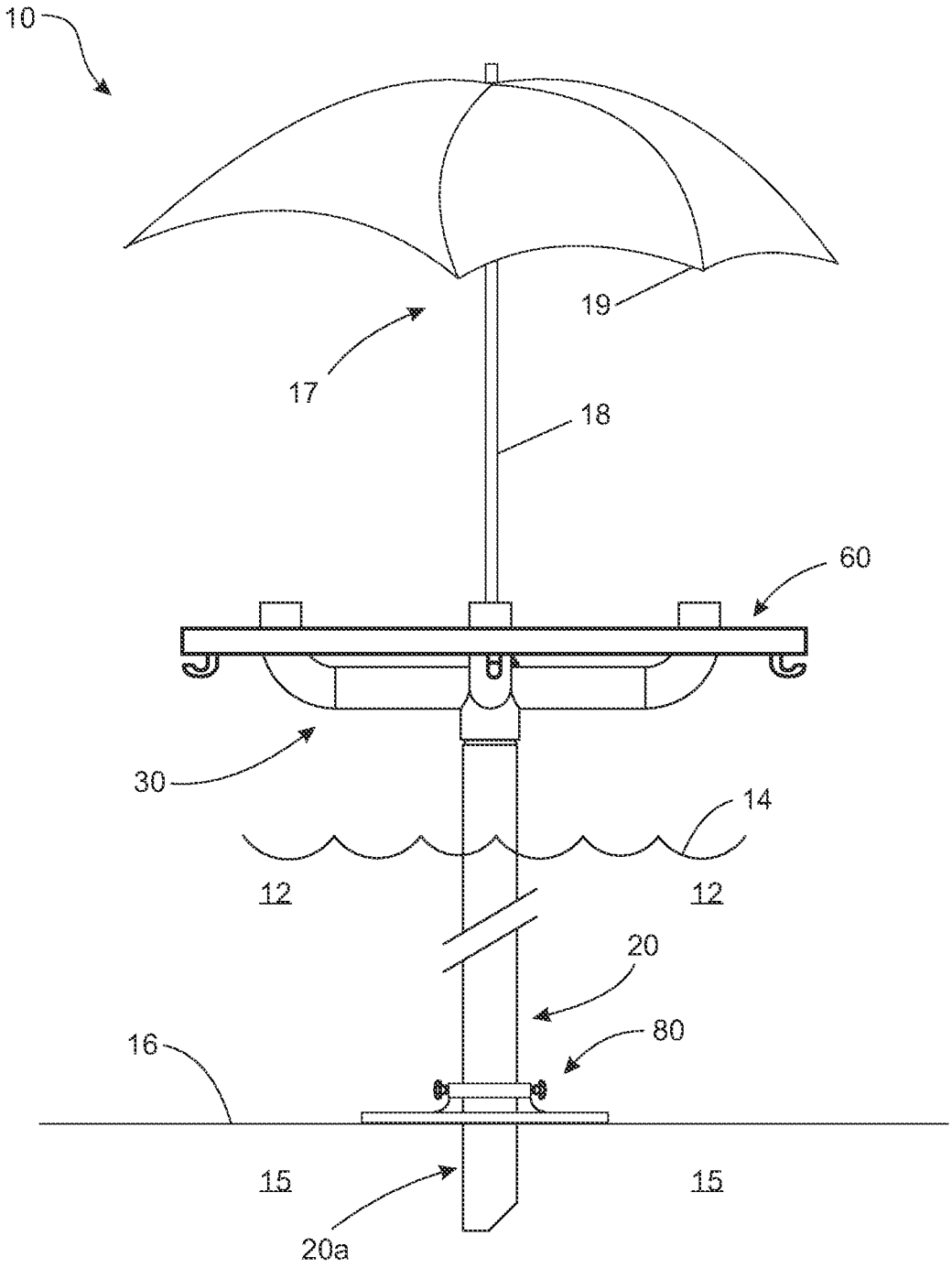
FIG. 1 presents a side elevation view of a first exemplary implementation of the umbrella anchoring, stabilizing, and accessory holding assembly of the present invention, shown in its assembled condition and anchored to the seabed/lakebed, in accordance with one illustrative application of the present invention.

Referring initially to FIG. 1, an umbrella support assembly 10 is disclosed according to one exemplary implementation of the present invention. The umbrella support assembly 10 is configured for use in combination with, for example, a conventional beach umbrella 17 having a support pole 18 and a deployable canopy 19 mounted to an upper end of the umbrella support pole. The primary application environment for using assembly 10 includes any shallow body of water generally illustrated at 12. The shallow body of water 12 may exist in areas that include, but are not limited to, the surf or breaker zone at ocean side (e.g., the swash area formed after an incoming wave has broken), shorelines of other bodies of water (e.g., bay, lake, and river), and certain natural topographies (e.g., sand bar, low tide areas). The shallow body of water 12 includes a surface 14 (i.e., water-air interface) and lies over a bed 15 having an upper surface 16. Depending on the application environment for deploying the umbrella support assembly 10, the bed 15 can have a composition including, for example, sand, shells, small rocks, and other sediment. In an ocean application, for example, the bed 15 would define the local seabed or ocean floor. Although the primary application environment for using the umbrella support assembly 10 is within a shallow body of water, the invention is not intended to be so limited. As will be readily apparent to those skilled in the art, umbrella support assembly 10 may be used on dry land as well.

Briefly, as discussed further, the umbrella support assembly 10 is configured with various operational features, including, but not limited to, holding umbrella 17 in an upright orientation, anchoring to bed 15 in a stable manner, and providing a means to secure and support a tabletop 60. During use, a user present in the shallow body of water 12 (e.g., standing, kneeling or sitting depending on the water depth) can experience several functionalities integrally offered by the beach surface umbrella assembly 10. For instance, the user can position herself under the canopy established by the deployed umbrella 17 and receive sun protection. Additionally, the user can access items securely carried by the supported tabletop, including, but not limited to, beverage containers, food, and other accessories (e.g., hat, sunscreen, goggles, sunglasses, snorkeling equipment, mobile phone, etc.). The user is able to leave the beach umbrella support assembly 10 unattended (e.g., to return briefly to shore or go for a swim) without making any accommodations or provisions for maintaining the assembly 10 in place, due to the bed-anchoring functionality.

Figure 2:
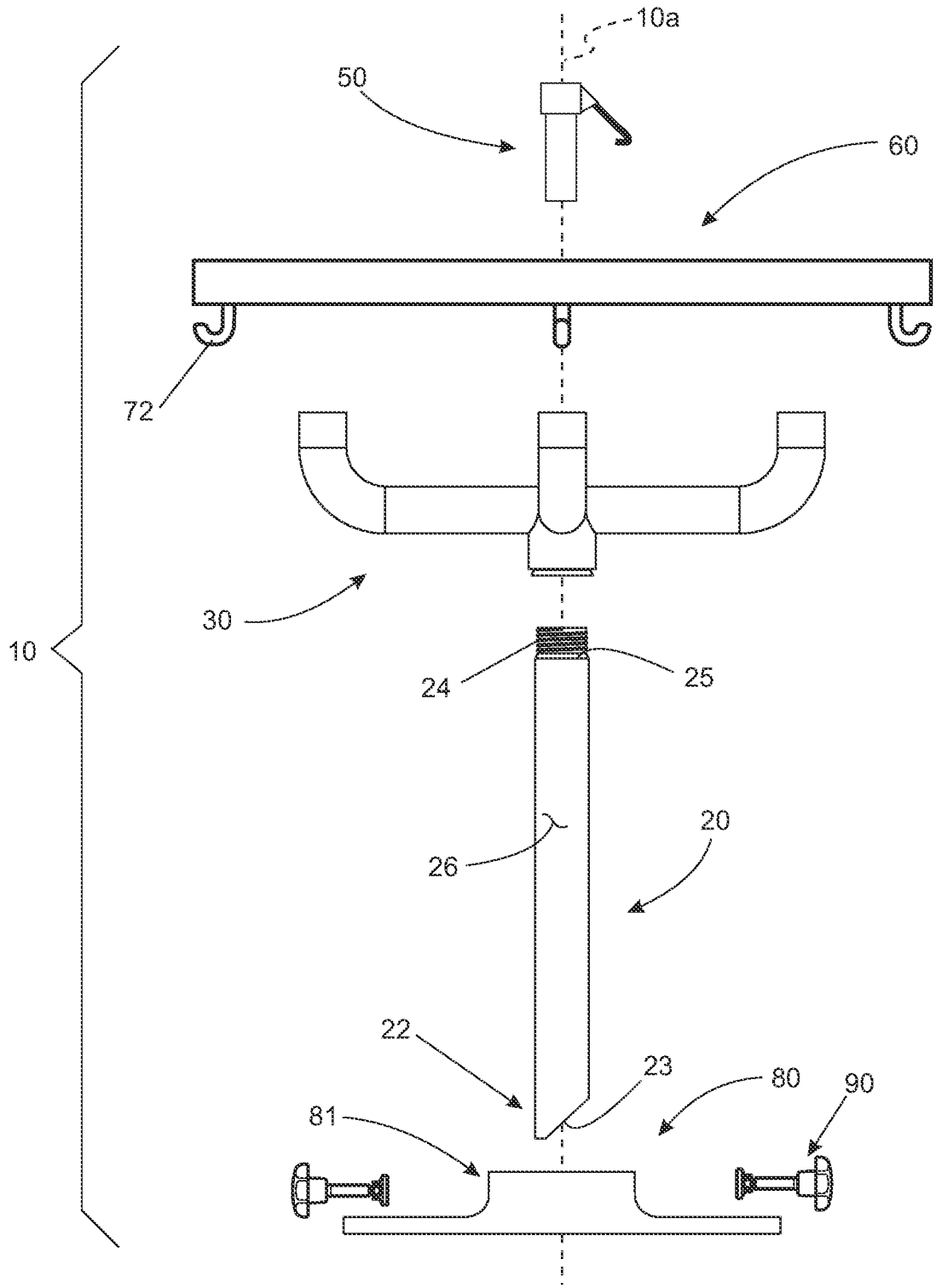
FIG. 2 presents an exploded side elevation view of the umbrella anchoring, stabilizing, and accessory holding assembly originally introduced in FIG. 1, with the removable umbrella not featured.

Referring more particularly to FIGS. 1 and 2, the umbrella support assembly 10 includes, in integral combination, a tubular central support rod 20, a multi-armed support structure 30, an umbrella pole-mounting clamp 50, a tabletop 60, and a stabilization plate subassembly 80. These individual components are integrated together using simple mechanical interfaces that do not require any moving parts. The entire unit can be manually assembled (and disassembled) without the use of any tools, power equipment or permanent fasteners. The umbrella support assembly 10 can be easily assembled and disassembled, since all the mating and attachment interfaces between components define releasable, reversible and temporary connections. Accordingly, in one form, the assembly 10 can be configured and packaged as a kit. As a result, a user entering the shallow body of water 12 can carry assembly 10 as a collection of parts packaged in a suitable bag and readily assemble the kit in the water, storing the bag with tabletop 60. Moreover, the components of assembly 10 are preferably made of a corrosion-free or substantially non-corrosive material that renders the umbrella support assembly 10 substantially immune from deterioration or degradation due to the natural elements in its application environment, specifically salt and water. In one form, for example, assembly 10 can have a material construction that includes, but is not limited to, plastics (e.g., PVC), polypropylene, polytetrafluoroethylene (PTFE), and any other suitable corrosion-resistant material. Additionally, each component of assembly 10 can be made with conventional production and manufacturing processes well known to those skilled in the art, requiring no specialized technology or machinery to fabricate.

In FIG. 1, umbrella support assembly 10 is shown in its assembled condition and deployed placement (i.e., integrated with umbrella 17 and located in its water-situated application environment). In FIG. 2, an exploded view of the umbrella support assembly 10 is shown with the individual components of the unit in their relative relationship to one another. Briefly, the tubular main support post 20 is configured at a distal or upper support end for support-type connection to multi-armed support assembly 30, and further configured at a proximal, or lower, insertion end for secure penetration into bed 15. As shown, central post 20 is located at an appropriate depth below the upper surface 16 of bed 15 to facilitate stable and enduring anchorage, which is indicated by embedded length or subterranean section **20*a* located at the lower insertion end of main post 20. The stabilization plate structure 80 is configured to centrally receive main support post 20 and function as a stand or anchoring means to securely hold main support post 20 in a vertical, or upright, orientation. The multi-armed support structure 30 is configured and otherwise disposed in a seating relationship to main support post 20 at its distal upper end and is further configured to receive, hold, and otherwise support tabletop 60 in a conventional horizontal orientation. The tabletop 60 is equipped with features to enable it to securely hold, store and otherwise carry a variety of accessory items, including, but not limited to, beverage containers and anything suitable for hanging. The umbrella 17 is centrally mounted via its support pole 18 to a central portion of the multi-armed support structure 30 and held in place by a suitable umbrella pole mounting clamp 50**.

Figure 3:
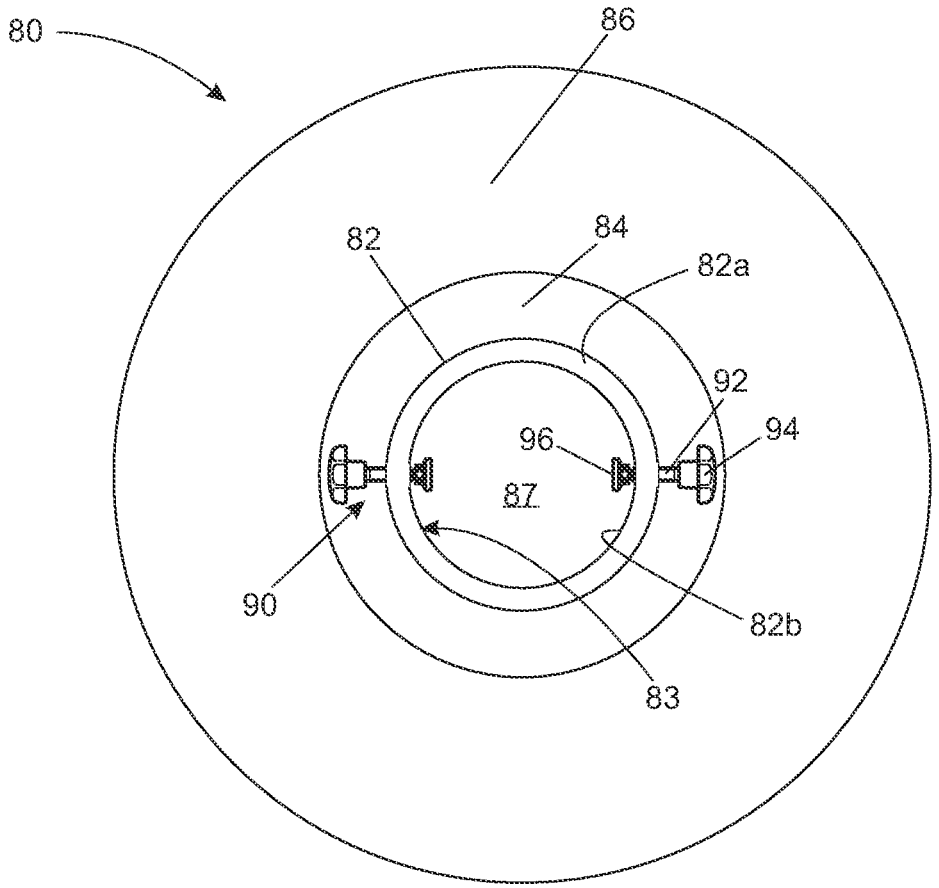
FIG. 3 presents an upper plan axial view of the anchoring stand used by the umbrella anchoring, stabilizing, and accessory holding assembly originally introduced in FIG. 1, which secures the assembly to the underlying bed.
Figure 4:
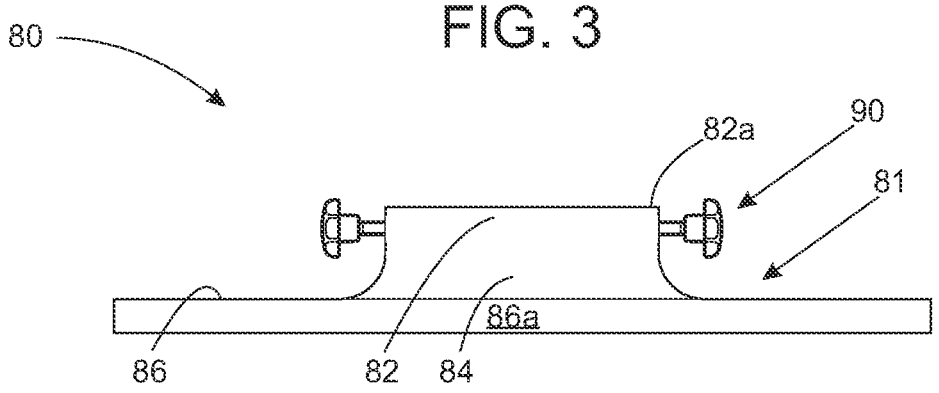
FIG. 4 presents a side elevation view of the anchoring stand originally introduced in FIG. 1 and further shown in FIG. 3.

Referring now primarily to FIGS. 3 and 4, with continuing reference to FIGS. 1 and 2, a more detailed description of the stabilization plate subassembly 80 follows. The stabilization plate subassembly 80 effectively functions, in one aspect, to anchor the umbrella support assembly 10 to bed 15 by securely holding the main support post 20 in a standing, vertical, upright orientation. The stabilization plate subassembly 80 may include, in combination, a unitary, or one-piece, stabilization plate 81 and a main/central support rod engagement component, such as a conventional male threaded stud clamping knob, generally illustrated at 90. The stabilization plate 81—preferably having a unitary, or one-piece, molded construction—functions as a stand, or pedestal, disposed on bed 15 (at upper surface 16), and is configured to receive and hold the tubular main support central post 20. In particular, the stabilization plate 81 facilitates the placement and holding of central support rod 20 in its driven, staked position in bed 15 (i.e., support rod 20 is driven into bed 15 to a depth corresponding to embedded length **20*a*). In so doing, the stabilization plate 81 also aids in supporting the overlying load comprising the combination of multi-armed support structure 30, tabletop 60, and umbrella 17, which are located and mounted at the upper distal end of central support rod 20. As described in greater detail below, the main support rod engagement component 90 (alternatively referred to herein as a "stabilization plate knob assembly." "stabilization plate securement knob," "male-threaded stud clamping knob" and the like) interacts and cooperates with stabilization plate 81 to engage and secure the central support rod 20 (following its deployment and insertion through plate 81), and aids in maintaining its vertical, upright orientation by counteracting any external forces exerted on the central support rod during use. For example, lateral forces applied to the central support rod 20, including any forces that may urge the support rod to pivot about its lower end, are counteracted by the force of the underlying bed 15 (i.e., at bed surface 16) against the flat lower surface of stabilization plate 81. Furthermore, any upward longitudinal force, or pulling force, on central support rod 20 (e.g., caused by wind against the interior of umbrella canopy 19) are at least partially counteracted by the natural downward force of the body of water 12 against exterior of stabilization plate 81** (i.e., particularly, against the flat upper surface area of the stabilization plate.

The stabilization plate 81, in one form, includes: an upper portion, or upper cylindrical wall portion 82; a lower portion, or planar annular base portion 86; and an intermediate transition portion, or intermediate wall portion 84, interconnecting the annular base portion 86 and the upper cylindrical wall portion 82. Preferably, the stabilization plate 81 has a unitary, monolithic, single-piece construction, such that the upper cylindrical wall portion 82, the planar annular base portion 86, and the intermediate wall portion 84, are contiguous with one another. The stabilization plate 81 is open-ended at both its top and bottom sides (upper section 82 and lower section 86, respectively) and defines a generally central passageway or post-receiving opening 87 extending fully and axially through the upper cylindrical wall portion 82, intermediate wall portion 84, and annular base portion 86.

The upper cylindrical wall portion 82 terminates at an upper edge 82*a*, thereby defining the uppermost terminus of stabilization plate 81. The upper cylindrical wall portion 82 includes an interior surface 82*b* that defines upper opening 83, which is sized and shaped to accommodate receipt of main support rod 20 therethrough. The upper cylindrical wall portion 82 has a generally cylindrical shape that is suitably sized, shaped and dimensioned to centrally and axially receive central rod 20, while still providing sufficient space and clearance to enable the stabilization plate knob assembly 90 to protrude into the interior of upper cylindrical wall portion 82 and exert a securing lateral hold on rod 20, as described in greater detail herein.

The annular base portion 86 has a generally planar construction and defines a resting platform directly disposed on the upper surface 16 of bed 15 during deployment. The base portion 86 is configured so that the stabilization plate subassembly 80 can provide a stable foundation for holding and supporting central support rod 20 and the components mounted thereto. As such, base portion 86 bears the entire weight of assembly 10. The size and shape of base portion 86 are preferably selected to provide effective stabilization of support rod 20 and the components mounted to it. Although base portion 86 is shown having an annular geometry, other configurations are possible without departing from the intended scope of the invention. The stabilization plate 81, and particularly the annular base portion 86, are configured to securely hold the central support rod 20 in an upright working (deployed) orientation and to maintain the stability of this relationship. The stabilization of central support rod 20 (loaded with the components mounted at its upper distal end) functions to maintain the central support rod 20 in its upright position (i.e., providing an anti-tipping function), and to counteract any lateral movement of main support post 20 (i.e., providing an anti-slipping function). The footprint, or profile/coverage area, of annular base portion 86 can be designed based on a variety of factors, including the expected turbulence in the shallow body of water 12 and the expected weight of the load carried by main support post 20 (i.e., umbrella 17, multi-armed support structure 30, tabletop 60, and any accessories carried by tabletop 60 or multi-armed structure 30). For instance, an increase in the footprint, or coverage area, of annular base portion 86 (i.e., increasing its dimensional area) will produce a corresponding increase in the resistance offered by the stabilization plate subassembly 80 to any tipping or slipping activity, as well as any other lateral, longitudinal, and rotational forces exerted on the central support rod 20. A principal external source of energy influencing displacement of the umbrella support assembly 10 would likely come from current or wave activity. The assembly 10 is designed to mitigate as much as possible the ability of wave turbulence to cause slipping or tipping activity in assembly 10. Furthermore, as previously described, the assembly 10 is designed to counteract various lateral, longitudinal, and rotational forces caused by wind activity.

The intermediate wall portion 84 defines a structural feature forming the transition between the upper cylindrical wall portion 82 and the flat annular base portion 86 of stabilization plate 81 of stabilization plate subassembly 80. The intermediate wall portion 84, in one form, has an outwardly curved, flaring, or concave-shaped taper, such that its diameter progressively increases in the direction from upper cylindrical wall portion 82 to annular base portion 86. The combination of upper cylindrical wall portion 82 and intermediate wall portion 84 forms a neck-like configuration that serves as the location where secured attachment to the inserted main support rod 20 is achieved with stabilization plate knob assembly 90. As discussed further, stabilization plate knob assembly 90 is integrated with upper cylindrical wall portion 82. The tapering or widening of the intermediate wall portion 84 provides structural reinforcement to the upper cylindrical wall portion 82 and helps establish a firm, stable, strengthened connection to the underlying flat annular base portion 86.

Referring still to FIGS. 3 and 4, the stabilization plate subassembly 80 may further include a stabilization plate knob assembly 90 designed to secure the inserted tubular main support rod 20 to stabilization plate 81, specifically via connection to the upper cylindrical wall portion 82. The stabilization plate knob assembly 90 may include, in combination, an externally threaded stainless steel threaded stud 92, a gripping knob 94 at a driving end of the stud, and a swivel thrust pad 96 disposed at an opposite working end, or contact end, of the stud. In order to receive threaded stud 92, a complementary threaded hole may be provided through the upper cylindrical wall portion 82 such that its threading axis is generally orthogonal to the longitudinal axis of the stabilization plate 81 (i.e., the dimension corresponding to the directional axis of insertion of tubular main support post 20 through axial passageway 87). The swivel thrust pad 96 is oriented such that its flat contact surface faces radially inward. The thrust pad 96 is configured to allow some degree of movement or swivel to facilitate flush contact with the target object (i.e., tubular main support post 20). As shown, the stabilization plate knob assembly 90 includes a pair of threaded studs 92 disposed opposite one another (i.e., 180 degrees apart). Additional threaded studs 92 (and corresponding threaded holes in upper cylindrical wall portion 82) can be added at other circumferential locations to increase the number of points of engagement with inserted central rod 20. In use, the stabilization plate subassembly 80 is deployed by seating the stabilization plate 81 (at flat annular base portion 86) on upper surface 16 of bed 15 in a shallow body of water 12. In order to maximize contact and optimize the stabilizing function, it is preferable to locate the annular base portion 86 of stabilization plate 81 on a substantially even and horizontal upper surface 16 of bed 15. The tubular main support pole 20 (without any loading) is first inserted or passed through the axial passageway 87 formed completely through the stabilization plate 81 and then driven into bed 15 to a depth of embedded length 20*a*. The inserted main support pole 20 preferably occupies a central location within axial passageway 87. While keeping the inserted pole 20 in an upright, vertical orientation, the user turns gripping knob 94 and threads the set (two) of threaded studs 92 through their corresponding holes in upper cylindrical wall portion 82 of stabilization plate 81. The threaded studs 92 are sufficiently advanced until the respective swivel thrust pads 96 contact the exterior outer surface 26 of tubular main support rod 20. Further advancement of threaded studs 92 is made to form a firm, tight, press fit connection between thrust pads 96 and pole 20 at its exterior surface 26. In this manner, the inserted post 20 is held in place in a vertical upright orientation. The stability of post 20 derives from a combination of the securing action of the actuated stabilization plate knob assembly 90, the anchoring action afforded by the location of an embedded length 20*a* of post 20 driven into bed 15, and the tipping-resistant feature of stabilization plate 81 due to the contact footprint made by flat annular base portion 86 with bed 15. The set of threaded studs 92 effectively function as set screw devices to exert a compressional force through the tip (at swivel thrust pads 96) to prevent relative movement between stabilization plate 81 and main post 20.

Referring now to FIGS. 5-9, with continuing reference to FIGS. 1 and 2, a more detailed description of the combination of multi-armed support structure 30 and tubular, central support rod 20 follows. The central support rod 20 is an elongate, hollow tube, rod, shaft or post that is open at both ends 22, 24 and defines a hollow interior void, space or volume 27 extending between the ends. The central support rod 20 includes an exterior, or outer, surface 26 and an interior, or inner, surface 27*a*, which circumscribes the interior volume 27. At its lower, or proximal, end 22, central support rod 20 has an open, tapered end (e.g., beveled or chamfered) having a structure designed for facilitating penetration of a ground surface; namely, bed 15 beneath shallow body of water 12. In particular, the open, tapered lower end 22 of central support rod 20 includes a leading edge 23 that defines an angled point of contact as rod 20 is operationally driven into bed 15. The tapering of leading edge 23 creates an angled contact surface that facilitates entry and advancement of rod 20 into bed 15. During deployment, the rod 20 is driven, planted and otherwise inserted into bed 15 in the manner of a staking operation. Additionally, since the tapered lower end 22 is open, sediment from bed 15 is encouraged to enter the hollow interior space 27 of rod as it is driven into bed 15. Significantly, the accumulation of sediment within interior volume 27 of central support rod 20 acts as a ballast that enhances the stability of post 20. At its opposite upper, or distal, end 24, the central support rod 20 includes an externally threaded upper end portion 24 that transitions to the main body of rod 20 via an annular shoulder 25. The upper end portion 24 is configured to axially receive the elongate support pole 18 of beach umbrella 17 within interior volume 27 and, as further described below, to receive the multi-armed support structure 30 in a seated, threaded mounting relationship. The central support rod 20 has a suitable length to accommodate several functionalities. For example, the length of central support rod 20 is sufficient to include a lower portion (i.e., embedded length 20*a*) adequate for stable penetration into bed 15, and an upper portion that suitably extends above the surface 14 of shallow body of water 12 so that the combination of multi-armed support structure 30 and tabletop 60 is adequately situated above water surface 14 to limit its exposure to water.

Figure 5A:
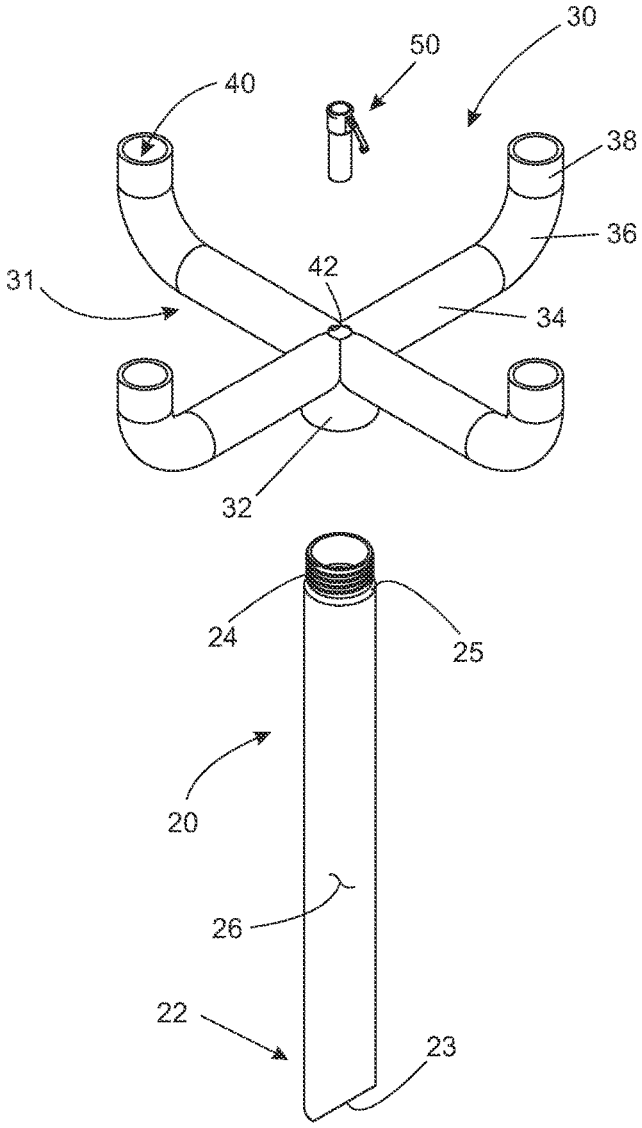
FIGS. 5A and 5B, respectively, present upper and lower isometric, exploded views of the multi-armed support structure of the umbrella anchoring, stabilizing, and accessory holding assembly originally introduced in FIG. 1, illustrating the manner of integrally connecting the main central support rod to the multi-armed support structure, and further illustrating the channel features enabling communication of the umbrella pole through the multi-armed support structure and central support rod.
Figure 5B:
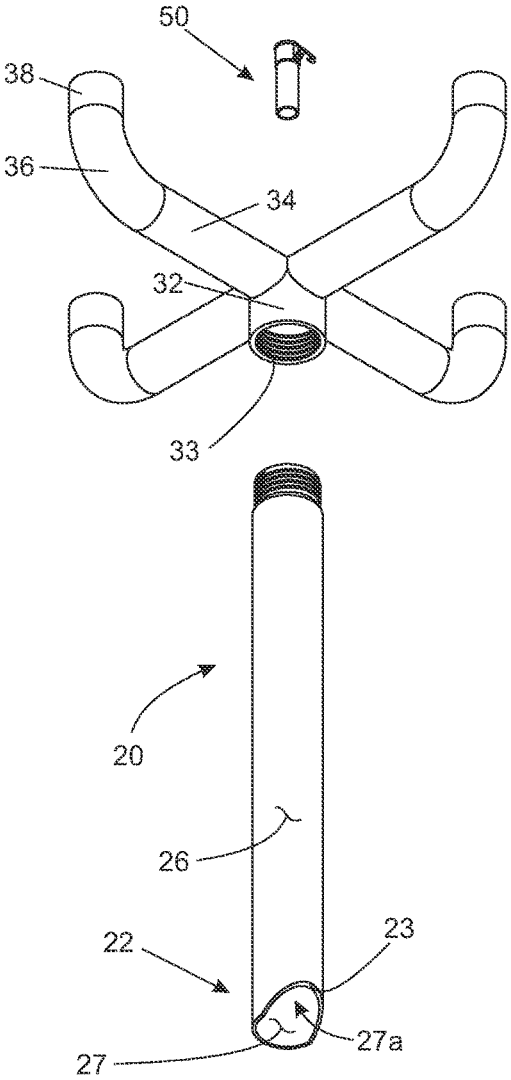
Figure 6:
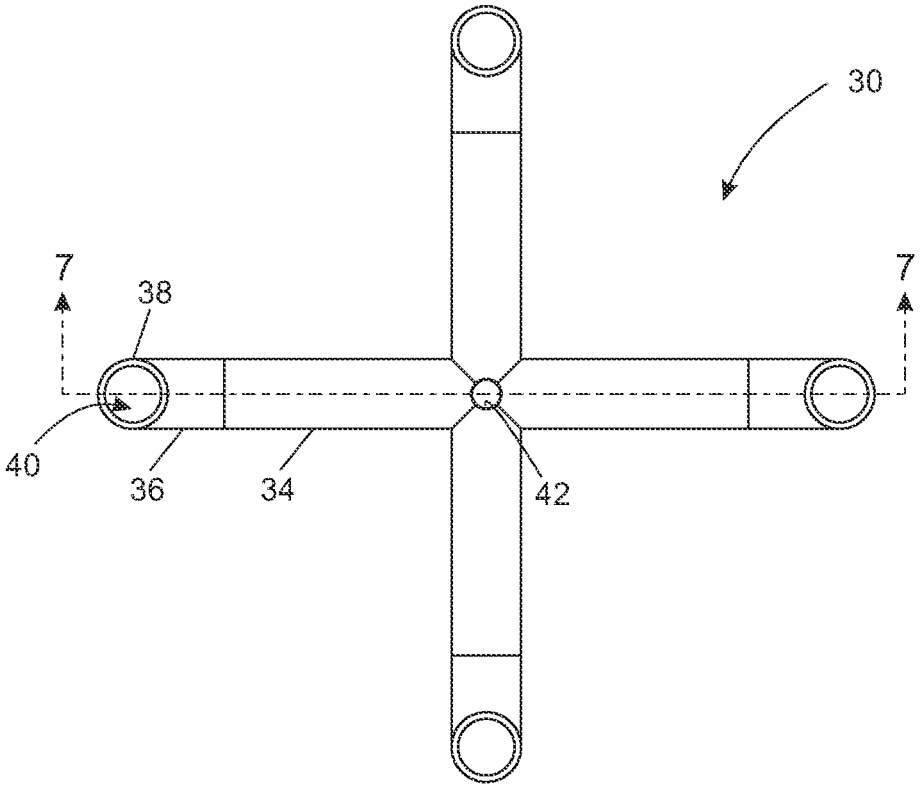
FIG. 6 presents an upper plan view of the multi-armed support structure originally introduced in FIG. 1 and further shown in FIGS. 5A and 5B, illustrating portals at the distal ends of each arm communicating with an interior hollow space.
Figure 7:
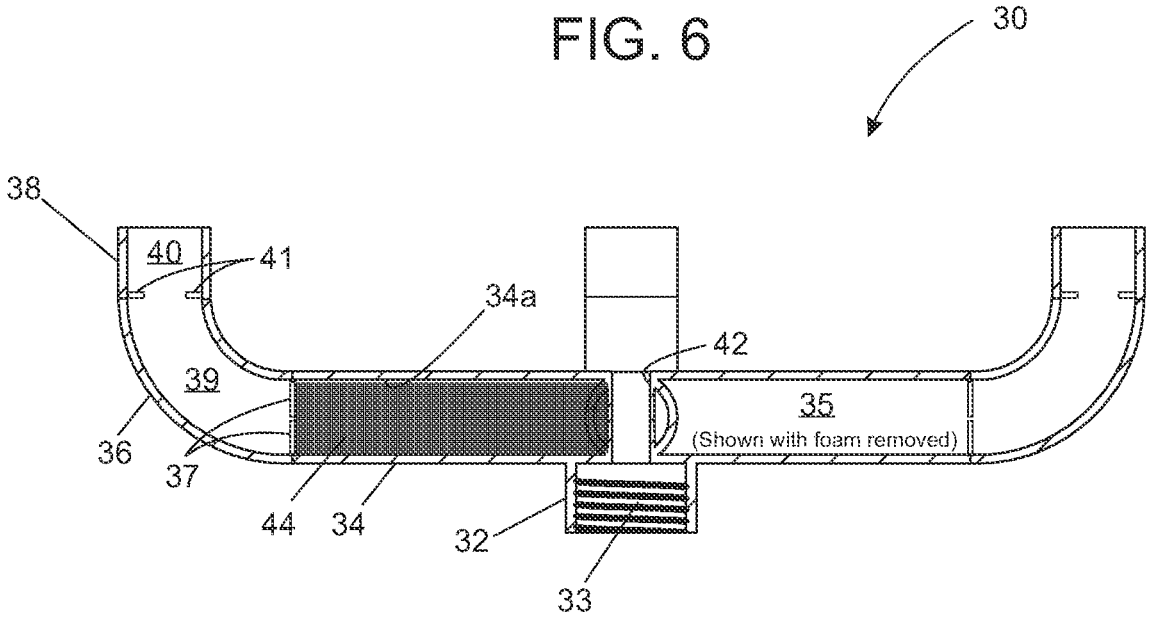
FIG. 7 is a vertical cross-sectional view of the multi-armed support assembly originally shown in FIG. 1 and further shown in FIG. 6, taken along section line 7-7 of FIG. 6, illustrating the insertion of a flotation element within the linear space of one arm and the removal of the flotation element from the opposing arm to depict the flotation-receiving compartment space.

Referring particularly to FIGS. 5-7, the multi-armed support structure 30 may include a set of spaced-apart arm assemblies (such as individual arm subassembly 31) each extending, or projecting, radially outward from a tubular central hub 32. The multi-armed support structure 30, in one form, can be configured as a hub-and-spoke arrangement. Each arm subassembly 31 of multi-armed support structure 30 preferably extends in a generally horizontal orientation relative to central hub 32. The central hub 32 may have a generally tubular, or cylindrical, formation including an internally threaded lower end portion 33, which, during assembly, forms a threaded connection with, or threadingly couples to, the externally threaded upper end portion 24 of tubular main support post 20 to facilitate the seated mounting of the multi-armed support rod 30 to central support rod 20. The central hub 32 of multi-armed support structure 30 is particularly sized and shaped such that, consequent to its threaded connection to central support rod 20, the terminal peripheral edge, or rim, of central hub 32 seats against, or otherwise engages with, the annular shoulder 25 at the upper end of the central support rod to define a flush and contiguous circumferential boundary. The multi-armed support structure 30 is configured with a central upper opening or passageway 42 that communicates with the internally threaded lower end portion 33 of tubular central hub 32. The central upper opening 42 is aligned with the central axis of tubular central hub 32. Additionally, central upper opening 42 is sized and shaped to receive and retain a beach umbrella pole mounting clamp 50, as described in further detail herein. Although a set of individual arm subassemblies 31 are shown, this depiction is merely illustrative and should not be considered in limitation of the present invention, as the multi-armed support structure 30 can be comprised of any number of individual arm subassemblies 31. The set of individual arm subassemblies 31 comprising multi-armed support structure 30 is preferably evenly spaced about tubular central hub 32. As will be readily apparent to those skilled in the art, each arm 31 may be alternatively constructed as a unitary, monolithic structure in lieu of an assembly of arm segments. Moreover, the entire multi-armed support structure (including central hub 32) may be alternatively constructed as a monolithic unit.

The representative individual arm subassembly 31 of multi-armed support assembly 30 includes, in combination: a linear interior/inner tube length 34 (or tube section 34), disposed adjacent to the tubular central hub 32 and defining an interior volume 35; a linear exterior/outer tube length 38 (or tube section 38) disposed distally of the tubular central hub 32 and defining an interior volume 40; and a curved intermediate tube length 36 (or tube section 36) interconnecting and defining the transition between the linear inner tubular length 34 and the linear outer tubular length 38, and further defining an interior volume 39. The intermediate tubular length 36 is contiguous at one end with inner tubular length 34 and contiguous at opposite end with outer tubular length 38, forming an integral conduit-type structure. In one form, the integral combination of inner length 34, intermediate length 36, and outer length 38 forms a generally J-shaped arrangement. Each arm subassembly 31 of multi-armed support structure 30 has an identical construction. Although the representative arm subassemblies 31 are depicted having individual conduit lengths, they may just as well have a unitary molded construction. In fact, it is contemplated to construct the entire multi-armed support assembly 30 as a unitary molded, or monolithic, structure. Furthermore, although the representative arm subassemblies are depicted having a curvature at their distal ends, it should be understood that they may be completely linear—or have any alternative form—as long as the distal ends are configured to receive and maintain beverage containers in an upright, vertical orientation.

The linear inner tubular length 34 includes an interior surface 35*a* defining an interior space, void, chamber or volume 35. The interior volume 35 is filled with a body of foam 44 to provide a buoyancy or flotation effect. The volume 35 of linear inner tubular length 34 of each arm subassembly 31 is preferably filled with a corresponding body of foam 44. The body of foam 44 is representative of any material product or composition having buoyancy or flotation characteristics. Any suitable conventional article can satisfy the choice of material for foam body 44, including, but not limited to, synthetic materials (e.g., plastic foam such as polyvinyl chloride and polyethylene) or natural materials (e.g., cork, balsa wood and kapok). The linear inner tubular length 34 is provided, at its distal end adjacent the curved intermediate tubular length 38, with an interior stop feature generally illustrated at 37, which projects inwardly from interior surface 35*a* of linear inner tubular length 34. The interior stop feature 37 acts as a structural impediment or barrier to prevent the body of foam 44 located in volume 35 of linear inner tubular length 34 from shifting or displacing into the adjacent intermediate tubular length 36, thereby containing and otherwise retaining the body of foam 44 within the volume 35 of linear inner tubular length 34. The interior stop feature 37 can have any suitable form to accomplish this barrier-forming action. For example, in one form, the interior stop feature 37 can be a disc-shaped body that forms an end cap to close or seal the linear inner tubular length 34 from the curved intermediate tubular length 36. Alternately, the interior stop feature 37 can include one or more cantilever-type structures that extend or project radially from the interior surface 35*a* of linear inner tubular length 34 but are so arranged to allow axial communication between the linear inner tubular length 34 and the curved intermediate tubular length 36.

The curved intermediate tubular length 36 forms an elbow-like transitional structure between the linear inner tubular length 34 and the linear outer tubular length 38. The curvature of intermediate tubular length 36 is sufficient so that the longitudinal directionality or contour of arm subassembly 31 changes from the generally horizontal axial orientation of linear inner tubular length 34 to a generally vertical axial orientation of linear outer tubular length 38. This generally vertical or upturned profile at the distal end of arm subassembly 31 facilitates the configuration and use of linear outer tubular length 38 as a container-receiving and container-holding receptacle within its volume 40, suitable to hold a beverage cup, for example. The linear outer tubular length 38 is open-ended at its distal free terminus end in order to provide access to interior volume 40. The linear outer tubular length 38 is configured with one or more interior annular stop features 41 that project inwardly from the interior surface of linear outer tubular length 38, functioning as a beverage container support surface. For example, a beverage container of suitable size can be positioned and otherwise situated within volume 40 of the linear outer tubular length 38, with the bottom of such container resting on the interior annular stop features 41. The degree of inward projection of interior annular stop features 41 need only be sufficient to define a suitable surface to support the container inserted in volume 40. The interior stop features 41 can have any suitable form, including, but not limited to, annular, split ring (annular-type sections), and cantilever-type radial extensions from the interior surface.

Figure 10:
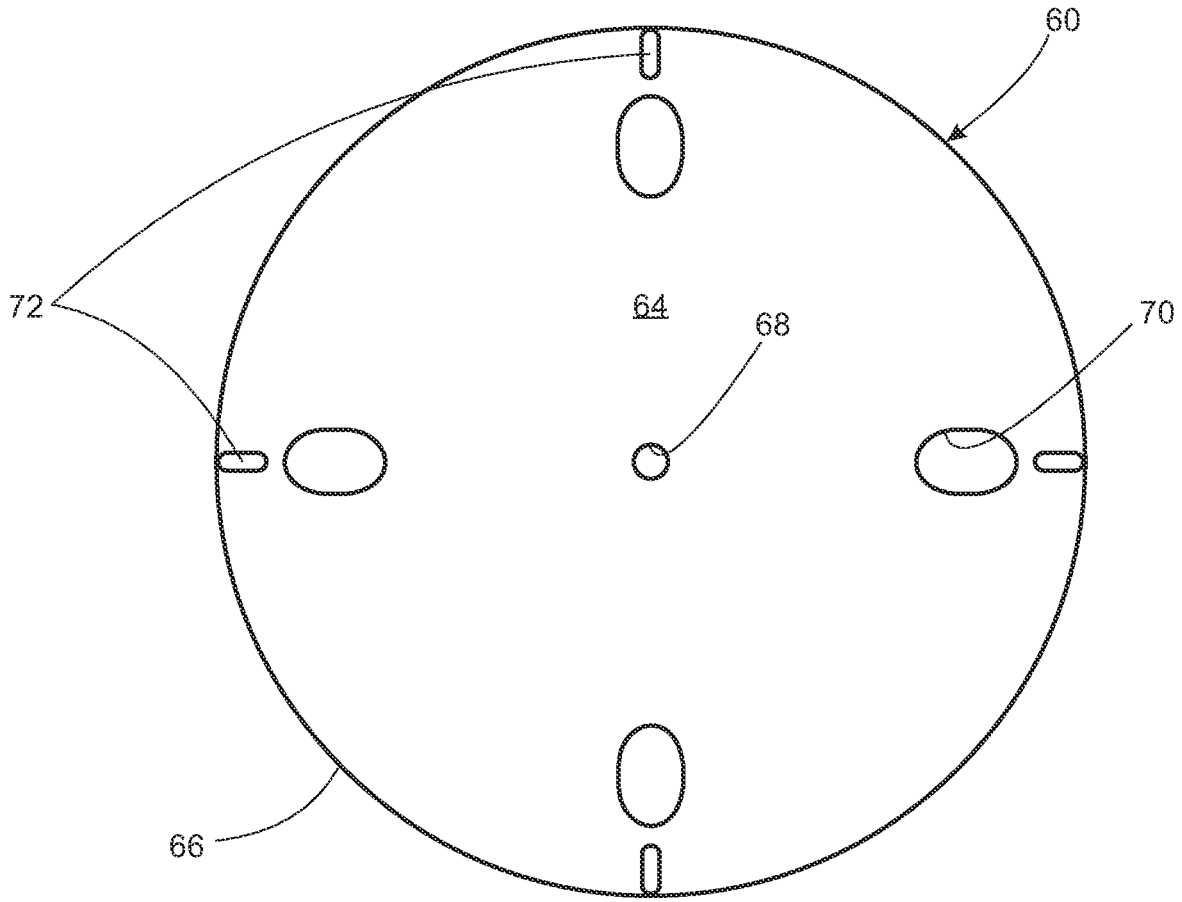
FIG. 10 presents a lower plan view of an accessory-carrying tabletop configured to seat on the multi-armed support structure of the umbrella anchoring and accessory holding assembly originally introduced in FIG. 1, illustrating the set of radially outward and peripherally spaced slots configured to receive the distal upturned ends of corresponding tabletop-support arms.
Figure 11:
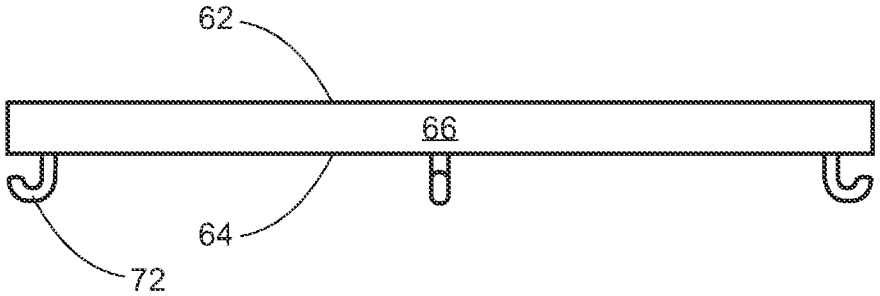
FIG. 11 presents a side elevation view of the tabletop originally introduced in FIG. 1 and further shown in FIG. 10, illustrating an arrangement of radially outward, circumferentially spaced article hanging support components in the form of J-shaped hooks.

Referring now to FIGS. 10 and 11, with continuing reference to FIGS. 1 and 2, a more detailed description of tabletop 60 is now provided. The tabletop 60, in one form, has a generally circular planar shape including an upper surface 62, a lower surface 64, and a peripheral, or circumferential, edge 66. The tabletop 60 is equipped with a set of J-shaped hooks 72 spaced at regular circumferential intervals and depending downwardly from lower surface 64 of tabletop 60. Each J-shaped hook 72 is preferably oriented so that the curvature of its opening faces radially outwards, in order to facilitate the hanging and retrieval of accessory items. The J-shaped hooks 72 can be situated at any suitable locations, but are preferably positioned proximal to, or adjacent to, the peripheral edge 66 of tabletop 60 to promote case and convenience of reach. Additionally, although hooks 72 are shown with a J-shaped configuration, any type, shape and size of hook 72 may be used. The J-shaped hooks 72 are representative of any article suitable to hold, retain, or otherwise catch an accessory item.

The tabletop 60 also includes a set of peripheral, radially spaced-apart table openings 70 extending between the upper surface 62 and the lower surface 64 of tabletop 60. The set of table openings 70 define an arrangement and spatial relationship that conforms to the geometry of the multi-armed support structure 30. In particular, the table openings 70 are suitably sized and shaped to receive the linear outer tubular length 38 of arm subassembly 31 therethrough (and also to partially receive the adjacent curved intermediate tubular length 36 of arm subassembly 31 therethrough). For this purpose, and to accommodate the joint communication of linear outer tubular length 38 (in full) and curved intermediate tubular length 36 (in part), the table opening 70 is preferably elliptically shaped, with the major axis of the elliptical shape generally aligned with a radial dimension of tabletop 60. During assembly, as shown in FIG. 1, the tabletop 60 is seated on the multi-armed support structure 30 by first aligning each table opening 70 with the vertically arranged linear outer tubular length 38 of a respective arm subassembly 31 of the multi-armed support structure 30. Maintaining this alignment, the user then lowers tabletop 60 onto the multi-armed support structure 30, such that each linear outer tubular length 38 passes completely through a respective tabletop opening 70. The user continues lowering tabletop 60 until the peripheral edge of table opening 70 (proximal the radially inner curvature of its elliptical shape) engages and contacts the curved intermediate tubular length 36 at its upward-facing side (i.e., the inside curvature). The tabletop 60, then, comes to rest in a seated relationship on multi-armed support assembly 30, specifically making multiple points of resting contact at the curved intermediate tubular length 36 of each arm subassembly 31. The table opening 70 may be suitably configured so that, in this resting condition of tabletop 60 on multi-armed support structure 30, the linear outer tubular length 38 (having passed through table opening 70) is disposed in intimate surface-to-surface engagement with the radially outward curvature of the elliptically shaped table opening 70—which helps lock tabletop 60 in place and prevents lateral and rotational movement thereof. Although the J-hooks 72 are shown in general radial alignment with table openings 70 (and located radially outward therefrom), this is for illustrative purposes only and should not be considered in limitation of the present invention, as other placements of J-hooks 72 relative table openings 70 are possible. The radial proximity of J-hooks 72 and table openings 70 may, however, prove expedient and convenient for the user, who is able to generally co-locate a beverage container in the open cavity formed by the linear outer tubular length 38 and an accessory item hanging nearby on an adjacent J-hook 72.

Figure 8:
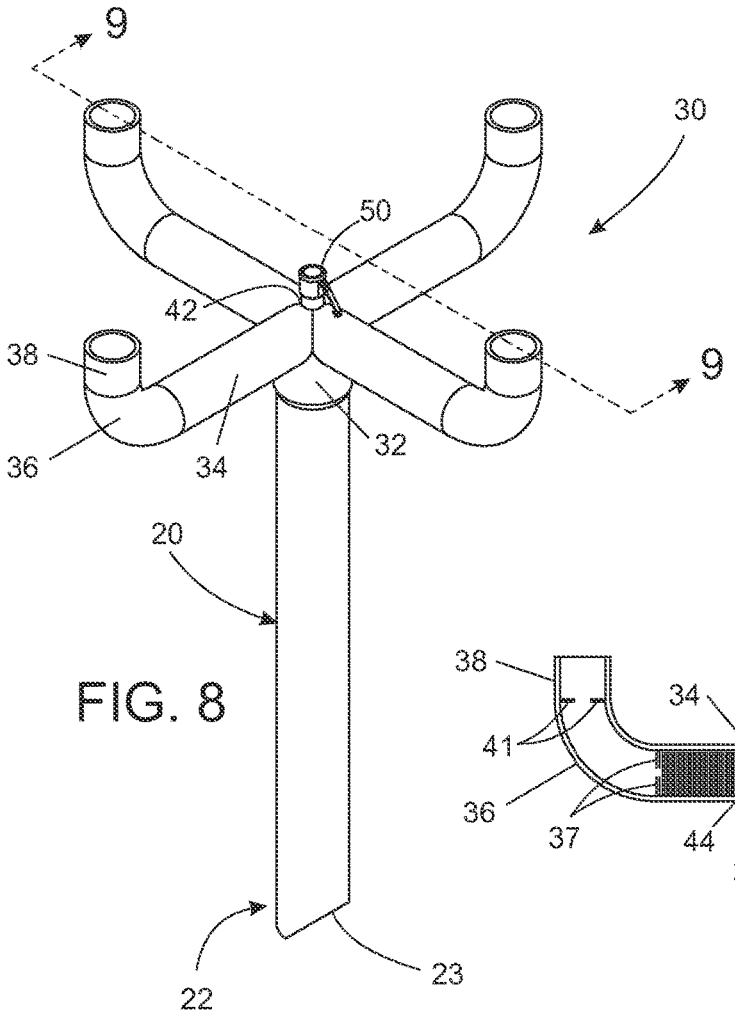
FIG. 8 presents an isometric view of the assembled combination of the multi-armed support structure and central support rod shown separated in FIGS. 5A-B.
Figure 9:
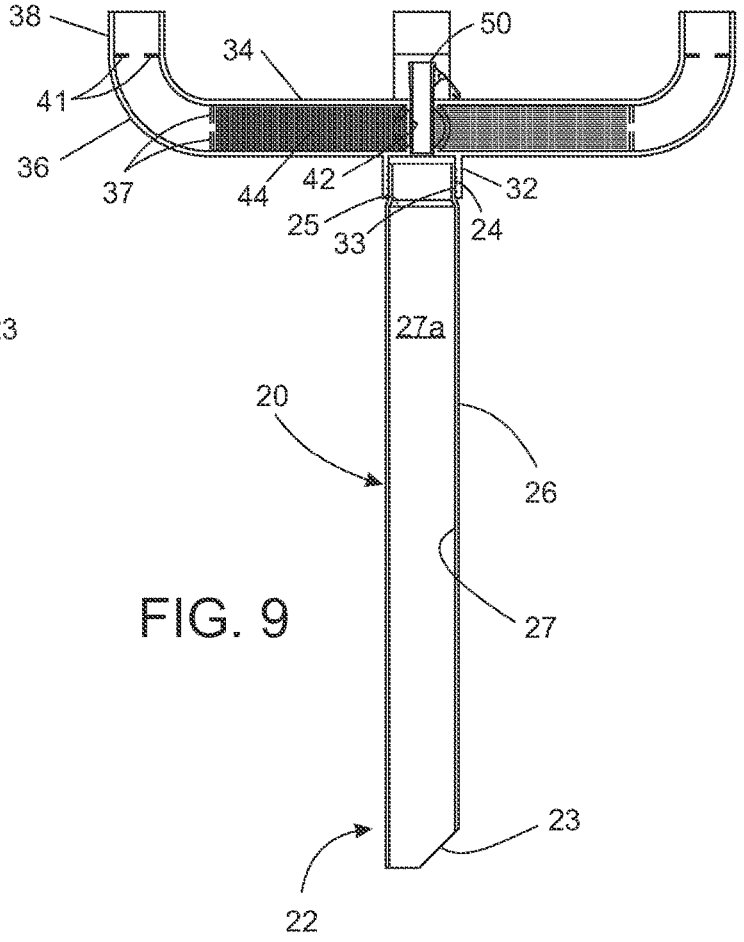
FIG. 9 presents a vertical cross-sectional view of the assembled combination of the multi-armed support assembly and central support post shown in FIG. 8, taken along section line 9-9 of FIG. 8, illustrating the integral placement of a pole-receiving device clamped to a central hub of the multi-armed support assembly.

Referring particularly to FIGS. 8 and 9, the umbrella support assembly 10 includes an umbrella pole-mounting clamp 50 that functions as a releasable clamping mechanism to secure umbrella 17 to the multi-armed support assembly 30. The pole-mounting clamp 50 has a generally cylindrical, tubular shape that is inserted into the central upper opening or slot 42 formed in multi-armed support assembly 30 above tubular central hub 32. The clamp 50 is open-ended at both ends and defines a pole-receiving and pole-retaining bore formed therethrough. The clamp 50 may be equipped with a radially outward annular shoulder to form an upper end portion that is diametrically larger than the central upper opening 42, so that this upper end portion of clamp 50 is seated above the central upper opening 42 and prevented from axial progress into central upper opening 42. Preferably, the clamp 50 is sized and shaped so that its uppermost terminus is sufficiently below the plane defined by the openings at the terminal ends of linear outer tubular length 38 (FIG. 9), which allows tabletop 60 to be seated on the multi-armed support assembly 30 without interference from clamp 50. Nevertheless, tabletop 60 is equipped with a central aperture 68 that extends from the upper surface 62 to the lower surface 64 of tabletop 60. This central aperture 68 is axially aligned with the central upper opening 42 formed in the multi-armed support assembly 30 and hence axially aligned with the pole-mounting clamp 50 inserted in and through central upper opening 42. As a result, once tabletop 60 is seated on the multi-armed support assembly 30, the umbrella support pole 18 of umbrella 17 can be inserted into clamp 50 following insertion through central aperture 68 of tabletop 60. Prior to the mounting of tabletop 60 on the multi-armed support assembly 30, the pole-mounting clamp 50 is inserted into central upper opening 42 formed in the multi-armed support assembly 30.

Additionally, since the central upper opening 42 of multi-armed support structure 30 is aligned with the central axis of tubular central hub 32 and, below it, with the central axis of tubular main support post 20, the user has the freedom to axially and telescopically lower the support pole 18 of umbrella 17 as far down as desired. For example, in a typical installation, the umbrella support pole 18 would be lowered by advancing it, in order, through umbrella pole-mounting clamp 50, the tubular central hub 32 of multi-armed support assembly 30, and the central support rod 20. If needed, the axial alignment of central aperture 68 of tabletop 60 with the central upper opening 42 of multi-armed support assembly 30 makes it possible for the head of the installed beach umbrella pole-mounting clamp 50 to pass through the central aperture 68 of tabletop 60. For this purpose, the central aperture 68 of tabletop 60 and the umbrella pole-mounting clamp 50 would be adequately sized and shaped to accommodate this feature. The pole-mounting clamp 50 could be any mechanism suitable to receive, secure, and otherwise retain the beach umbrella support pole 18 of umbrella 17. In one form, for example, the pole-mounting clamp 50 can have a releasable control lever that, when actuated, tightens a collar or sleeve around the inserted beach umbrella support pole 18, forming a peripherally acting compression grip on pole 18. The user can actuate this lever once the beach umbrella support pole 18 is extended a satisfactory length through clamp 50. The pole-mounting clamp 50 can be implemented with any conventional clamping mechanism suitable to form a releasable gripping or holding action on a cylindrical rod or shaft (i.e., umbrella support pole 18).

The assembly 10 of the present invention provides an integrated, all-in-one arrangement that offers the user a variety of functionalities integrated into a single platform. For example, assembly 10 offers the user sun protection via umbrella 17, access to beverage containers securely stored in the linear outer tubular length 38 of an arm subassembly 31, access to food items located on the upper surface 62 of tabletop 60, and access to other accessory items (e.g., sunblock, hat, mobile phone, etc.) held in a bag (or other containment article) hung from the lower surface 64 of tabletop 60 via hooks 72. The degree or coverage of sun protection can be adjusted by changing the amount of telescoping of the umbrella support pole 18 within the tubular main support post 20. Additionally, the amount of stability afforded by tubular main support post 20 can be adjusted by changing the depth of penetration (i.e., embedded length 20*a*) in bed 15.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An umbrella support assembly for supporting an umbrella within a shallow body of water overlying a bed, the umbrella having a deployable canopy at an upper end of a support pole, the umbrella support assembly comprising:

an elongated, tubular main support rod having an open-ended, tapered insertion end and an opposite open-ended, attachment end, the tubular main support rod oriented along an umbrella support assembly central axis;

a multi-armed support structure releasably attachable to the attachment end of the main support rod, the multi-armed support structure having a plurality of tubular arms projecting radially outward from a common central portion thereof, and having a tubular central hub depending downwardly from a bottom portion of the common central portion, interior ends of the plurality of tubular arms, together, defining a central upper opening sized and shaped for accommodating an umbrella pole-mounting clamp therein, the central upper opening concentric with the umbrella support assembly central axis;

a tabletop supported upon the multi-armed support assembly; and a stabilization plate subassembly oriented along the umbrella support assembly central axis, and selectively mountable about a lower end of the main support rod, a distance above the tapered insertion end thereof, for releasably securing the main support rod as the main support rod adopts, during use, a generally vertical orientation with an embedded length of the main support rod lower end, between the stabilization plate subassembly and the tapered insertion end of the main support rod, penetrating the bed underlying the shallow body of water such that the bed material fills the embedded length of the main support rod lower end to provide ballast-like stability.

2. The umbrella support assembly recited in claim 1, wherein the stabilization plate subassembly further comprises:

a stabilization plate at least partially defined by an annular planar base portion transitioning interiorly into an upwardly extending cylindrical wall portion to define a central passageway concentric with the umbrella support assembly central axis, the central passageway sized and shaped to accommodate the tapered insertion end of the elongated, tubular main support rod therethrough, the annular base portion having upper and lower surfaces, and terminating exteriorly at a peripheral edge; and a main support rod engagement component integrated with the stabilization plate to enable releasable attachment of the stabilization plate to the lower end of the main support rod.

3. The umbrella support assembly recited in claim 1, wherein, during use:

the lower surface of the annular base portion of the stabilization plate abuts, and is supported upon, an upper surface of the bed; and the shallow body of water imparts a downward force against the upper surface of the annular base portion of the stabilization plate to further secure the position and vertical orientation of the beach umbrella support assembly.

4. The umbrella support assembly recited in claim 3, wherein each one of the plurality of tubular arms of the multi-armed support structure terminates at a distal end in the form of a beverage container structure.

5. The beach umbrella support assembly recited in claim 4, wherein each one of the plurality of tubular arms of the multi-armed support structure further comprises:

a linear inner tubular length having a first interior volume;

an open-ended linear outer tubular length having a second interior volume; and an arcuate intermediate tubular length having a third interior volume, the arcuate intermediate tubular length interconnecting the linear inner tubular length and the linear outer tubular length, wherein the open-ended linear outer tubular length is bounded at a lower end by an interior stop feature protruding interiorly from an interior surface of the outer tube length, and wherein the beverage container structure at the distal end of the open-ended linear outer tubular length is sized and shaped to securely accommodate a beverage container therein.

6. The umbrella support assembly recited in claim 5, wherein the tabletop further comprises:

a central opening extending completely therethrough and concentric with the umbrella support assembly central axis; and a plurality of radially spaced peripheral openings extending completely therethrough, wherein, the plurality of radially-spaced peripheral openings align with open ends of the open-ended linear outer tubular lengths of the plurality of tubular arms of the multi-armed support structure, such that, during assembly of the tabletop to the multi-armed support structure, the open-ended linear outer tubular lengths extend completely through the corresponding radially-spaced peripheral openings, and the tabletop is entirely supported upon the arcuate intermediate tubular lengths of the corresponding plurality of tubular arms of the multi-armed support structure.

7. The umbrella support assembly recited in claim 6, wherein the plurality of radially spaced peripheral tabletop openings further comprise elliptically shaped openings.

8. The umbrella support assembly recited in claim 6, further comprising a plurality of article hanging support components depending downwardly from the tabletop.

9. The umbrella support assembly recited in claim 4, further comprising a plurality of article hanging support components depending downwardly from the tabletop.

10. The umbrella support assembly recited in claim 4, further comprising a volume of a buoyant flotation material at least partially filling the first interior volume of the linear inner tubular length.

11. The umbrella support assembly recited in claim 10, further comprising an interior stop feature separating the first interior volume of the linear inner tubular length and the third interior volume of the arcuate intermediate tubular length.

12. The umbrella support assembly recited in claim 1, further comprising a plurality of article hanging support components depending downwardly from the tabletop.

13. The umbrella support assembly recited in claim 1, wherein at least one of the plurality of tubular arms of the multi-armed support structure has a volume of a buoyant flotation material integrated therein.

14. The umbrella support assembly recited in claim 1, wherein:

the tubular central hub depending downwardly from the bottom portion of the common central portion of the multi-armed support structure further comprises an open-ended, internally threaded cylindrical wall; and the attachment end of the elongated, tubular main support rod is externally threaded to accommodate selective threading attachment to the internally threaded cylindrical wall of the tubular central hub.

15. An umbrella support assembly for supporting an umbrella within a shallow body of water overlying a bed, the umbrella having a deployable canopy at an upper end of a support pole, the umbrella support assembly comprising:

an elongated tubular main support rod having an open-ended, tapered insertion end and an opposite open-ended, attachment end;

a stabilization plate releasably attachable to the tubular main support rod proximate the attachment end thereof, the stabilization plate generally defined by an annular planar base portion transitioning interiorly and upwardly to a cylindrical wall portion, the cylindrical wall portion defining a central passageway sized and shaped for accommodating the tapered insertion end of the tubular main support rod therethrough such that the stabilization plate may be slidably adjusted therealong;

a stabilization plate mechanical fastening component adapted to enable the stabilization plate to be selectively secured along a lower length of the main support rod above the tapered insertion end thereof;

a multi-armed support structure releasably attachable to the attachment end of the tubular main support rod, the multi-armed support structure comprising a tubular central hub in the form of a cylindrical sidewall having an upper end and an internally threaded open lower end, and a plurality of radially spaced tubular arms contiguous with the upper end of the tubular central hub and projecting radially outward therefrom, adjoined proximal ends of the tubular arms defining a multi-armed support structure upper opening sized, shaped, and otherwise adapted for accommodating a beach umbrella pole-mounting clamp therein, wherein each of the plurality of tubular arms terminates distally at an open-ended linear tubular arm segment that is sized, shaped, and otherwise adapted to accommodate a beverage container therein;

a planar tabletop supported upon the multi-armed support structure, the planar tabletop defined by an upper surface, an opposite lower surface, and a peripheral edge, the planar tabletop having a central opening extending completely therethrough, the central opening sized, shaped, and otherwise adapted for receiving a beach umbrella pole-mounting clamp partially therethrough, the planar tabletop having a plurality of radially-spaced openings provided extending completely therethrough, the plurality of radially-spaced openings aligned with the open-ended linear tubular arm segments of the corresponding plurality of tubular arms, and the plurality of radially-spaced openings sized and shaped for enabling passage of the open-ended linear tubular arm segments therethrough; and a plurality of accessory-hanging hooks depending downwardly from the lower surface of the planar tabletop, wherein the elongated tubular main support rod, the stabilization plate, the multi-armed support structure, and the planar tabletop all being concentric about a common central axis of the beach umbrella support assembly, and wherein, during use, the lower surface of the annular base portion of the stabilization plate is supported upon an upper surface of the bed underlying the shallow body of water, and the upper surface of the annular base portion of the stabilization plate is acted upon by a downward force imparted by the overlying shallow body of water, the downward force imparted by the overlying shallow body of water functioning to maintain the beach umbrella support assembly in a generally upright and vertical orientation, while also counteracting any upward force caused by wind beneath the beach umbrella canopy.

* * * * *